US007325332B2

(12) United States Patent
Chung et al.

(10) Patent No.: US 7,325,332 B2
(45) Date of Patent: Feb. 5, 2008

(54) CLOTHING DRYER

(75) Inventors: Young Suk Chung, Suwon-Si (KR); Jung Ho Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/209,671

(22) Filed: Aug. 24, 2005

(65) Prior Publication Data

US 2006/0123652 A1 Jun. 15, 2006

(30) Foreign Application Priority Data

Dec. 14, 2004 (JP) ..... 10-2004-0105636

(51) Int. Cl.
*F26B 11/02* (2006.01)

(52) U.S. Cl. ..... 34/602

(58) Field of Classification Search ..... 34/82, 34/602; 15/401

See application file for complete search history.

(56) References Cited

U.S. PATENT DOCUMENTS 3,043,015 A * 7/1962 Brucken ..... 34/80
5,535,478 A * 7/1996 Thompson ..... 15/401
6,481,047 B1 * 11/2002 Schaefer ..... 15/314

FOREIGN PATENT DOCUMENTS

| | | | |
|---|---|---|---|
| DE | 38 17 849 | A1 | 12/1989 |
| EP | 1 380 683 | A2 | 1/2004 |
| KR | 10-2002-76585 | A | 10/2002 |
| KR | 10-2004-0011216 | A | 2/2004 |
| KR | 10-0446764 | B1 | 9/2004 |

OTHER PUBLICATIONS

Japanese Abstract No. 2003340197, dated Dec. 2, 2003.
Japanese Abstract No. 06015098, dated Jan. 25, 1994.
Japanese Abstract No. 2003275497, dated Sep. 30, 2003.
Japanese Abstract No. 07116388, dated May 9, 1995.
Japanese Abstract No. 03026299, dated Feb. 4, 1991.
Japanese Abstract No. 07136395, dated May 30, 1995.

* cited by examiner

*Primary Examiner*—S. Gravini
(74) *Attorney, Agent, or Firm*—Sughrue Mion, Pllc.

(57) ABSTRACT

A clothing dryer capable of removing impurities, such as dust, accumulated in a hot air outlet duct thereof. The clothing dryer includes a drying tub to dry laundry contained therein using hot air supplied thereto, a hot air outlet duct to discharge the hot air, coming from the drying tub, to the outside, and a connecting unit to connect an external suction device to the hot air outlet duct. Accordingly, impurities, such as dust, accumulated in the hot air outlet duct can be removed by a suction force of the suction device, thereby enabling the cleaning of the hot air outlet duct.

8 Claims, 4 Drawing Sheets

CLOTHING DRYER

CROSS-REFERENCE TO RELATED APPLICATION

This application claims priority from Korean Patent Application No. 2004-105636, filed on Dec. 14, 2004 in the Korean Intellectual Property Office, the disclosure of which is incorporated herein by reference.

BACKGROUND OF THE INVENTION

1. Field of the Invention

The present invention relates to a clothing dryer and, more particularly, to a clothing dryer comprising a connecting unit for use in the cleaning of a hot air outlet duct that guides hot air to the outside.

2. Description of the Related Art

In general, a clothing dryer is designed forcibly to blow hot air into a drying tub to dry wet laundry contained in the drying tub. Such a clothing dryer is provided with a heater and blowing fan forcibly to circulate the hot air to the drying tub, thereby drying the laundry.

A conventional clothing dryer, as disclosed in Korean Patent Registration No. 10-446764, comprises a housing provided at its front side with a door, a cylindrical drying tub longitudinally disposed in the housing, a hot air inlet duct having one end connected to a rear side of the drying tub to introduce hot air into the drying tub, a heater mounted in the hot air inlet duct to change outside air to the hot air, a hot air outlet duct to discharge the hot air, coming from the drying tub, to the outside under the operation of a blowing fan mounted therein, a hot air guiding section to guide the hot air from the drying tub to the hot air outlet duct, a lattice-patterned grill member mounted at the top of the hot air guiding section as a partition wall between the drying tub and the hot air guiding section, and a filter mounted in the hot air guiding section to remove impurities, such as dust, lint, etc., from the hot air passing through the guiding section.

In the case of the conventional clothing dryer configured as stated above, however, if a flow rate of the hot air, passing through the drying tub, is excessively high, the hot air fails to sufficiently transfer its heat to laundry contained in the drying tub and thus is discharged to the outside at high temperature, resulting in a waste of heat. Therefore, the blowing fan provided in the clothing dryer must have a predetermined blowing force to provide the hot air with a flow rate suitable to contact with the laundry for a sufficient time.

Another problem of the conventional clothing dryer is that minute impurities, such as dust, lint, etc., not captured by the filter, are accumulated in the hot air outlet duct with the passage of time, thereby reducing the flow rate of the hot air discharged via the hot air outlet duct.

Although it is preferable to remove the impurities accumulated in the hot air outlet duct using a blowing air, since the blowing force of the blowing fan provided at the conventional clothing dryer is set only to dry the laundry contained in the drying tub, it is difficult to discharge the impurities adhered to the inner peripheral surface of the hot air outlet duct to the outside with such a blowing force.

SUMMARY OF THE INVENTION

Therefore, the present invention has been made in order to solve the above problems, and it is an aspect of the invention to provide a clothing dryer capable of facilitating the removal of impurities accumulated in a hot air outlet duct thereof.

In accordance with one aspect, the present invention provides a clothing dryer comprising: a drying tub for drying laundry contained therein using hot air supplied thereto, a hot air outlet duct which discharges the hot air, coming from the drying tub, to the outside, and a connecting unit which transmits an external suction force to the hot air outlet duct to allow impurities accumulated in the hot air outlet duct to be removed by the external suction force, thereby enabling the cleaning of the hot air outlet duct.

The connecting unit may be connected to an external suction device to transmit the suction force produced by the external suction device to the hot air outlet duct.

The connecting unit may include a connector portion connected to the external suction device to guide outside air to the suction device, and a guide portion extending downwardly from the connector portion to be located at the front side of the hot air outlet duct to guide the outside air from the hot air outlet duct to the connector portion.

The dryer may further comprise a grill member provided with a grill portion having a lattice pattern to permit passage of the hot air from the drying tub, a hot air guiding section mounted below the grill member to guide the hot air, passed through the grill member, to the hot air outlet duct, a filter detachably mounted in the hot air guiding section by passing through the grill member to separate impurities from the hot air flowing through the hot air guiding section, and a filter fitting slot formed at the grill member to detachably mount one of the filter and the connecting unit.

The connecting unit may further include a cover portion located inside the grill member at the front side of the grill portion to prevent introduction of the hot air from the drying tub.

The external suction device may include a vacuum cleaner.

In accordance with another aspect, the present invention provides a clothing dryer comprising: a drying tub for drying laundry contained therein using hot air supplied thereto, a hot air outlet duct which discharges the hot air, coming from the drying tub, to the outside, and a connecting unit which connects an external vacuum cleaner with the hot air outlet duct to allow impurities contained in the hot air outlet duct to be suctioned into the vacuum cleaner by a suction force of the vacuum cleaner, thereby enabling the cleaning of the hot air outlet duct.

The dryer may further comprise: a grill member provided with a grill portion having a lattice pattern to permit passage of the hot air from the drying tub, a hot air guiding section mounted below the grill member to guide the hot air, passed through the grill member, to the hot air outlet duct, a filter detachably mounted in the hot air guiding section by passing through the grill member to separate impurities from the hot air flowing through the hot air guiding section, and a filter fitting slot formed at the grill member to detachably mount the filter, and the connecting unit may be detachably mounted in the hot air guiding section via the filter fitting slot, instead of the filter.

The connecting unit may include: a connector portion connected to a suction pipe of the vacuum cleaner to guide outside air to the vacuum cleaner using the suction force transmitted via the suction pipe, a guide portion located inside the hot air guiding section at the front side of the hot air outlet duct to guide the outside air from the hot air outlet duct to the connector portion, and a cover located inside the grill member at the front side of the grill portion.

Additional aspects and/or advantages of the invention will be set forth in part in the description which follows and, in part, will be apparent from the description, or may be learned by practice of the invention.

BRIEF DESCRIPTION OF THE DRAWINGS

These and/or other aspects and advantages of the invention will become apparent and more readily appreciated from the following description of the exemplary embodiments, taken in conjunction with the accompanying drawings, in which.

Figure 1:
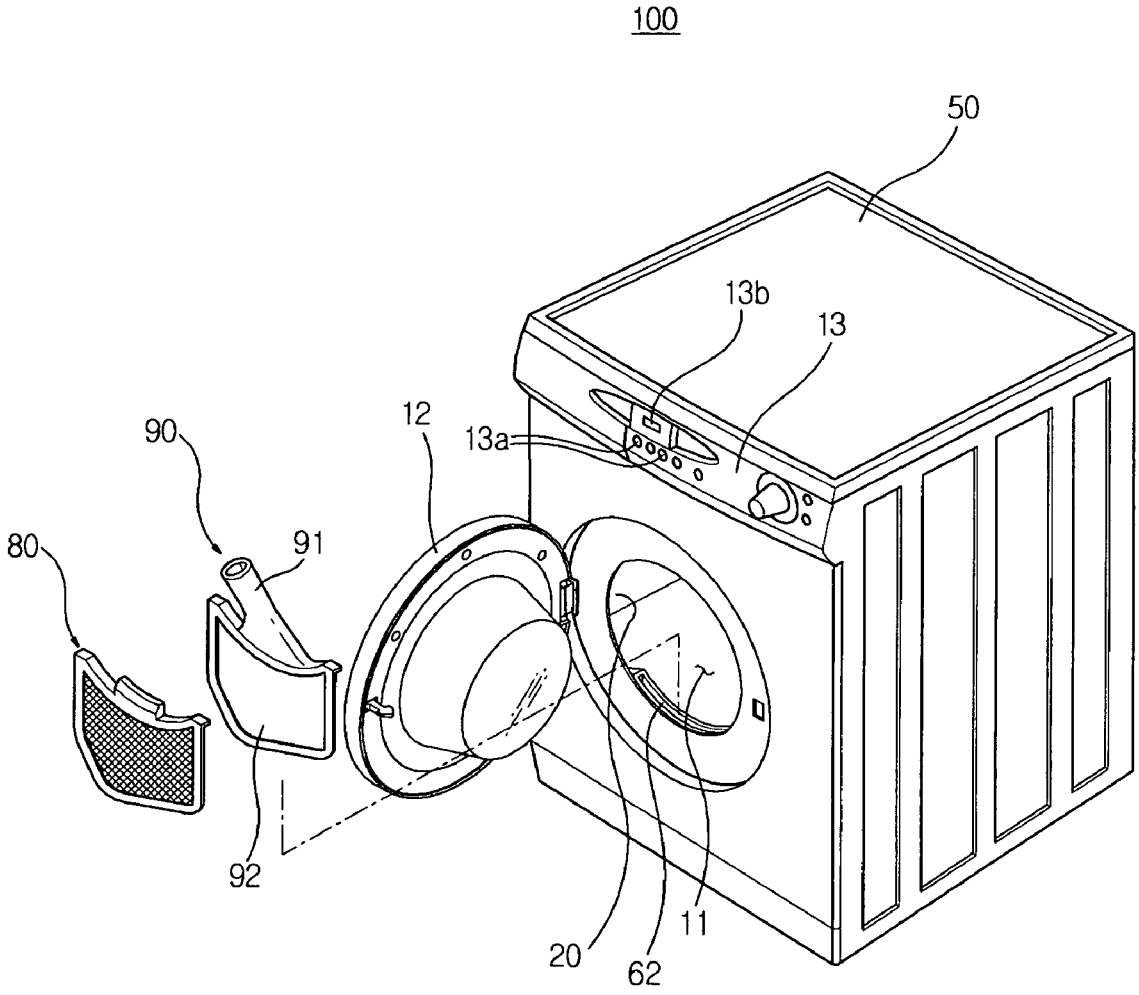
FIG. 1 is a perspective view of a clothing dryer consistent with an exemplary embodiment of the present invention.

DETAILED DESCRIPTION OF THE ILLUSTRATIVE, NON-LIMITING EMBODIMENTS OF THE INVENTION

Reference will now be made in detail to an exemplary embodiment of the present invention illustrated in the accompanying drawings, wherein like reference numerals refer to like elements throughout. The embodiment is described below to explain the present invention by referring to the figures.

Figure 2:
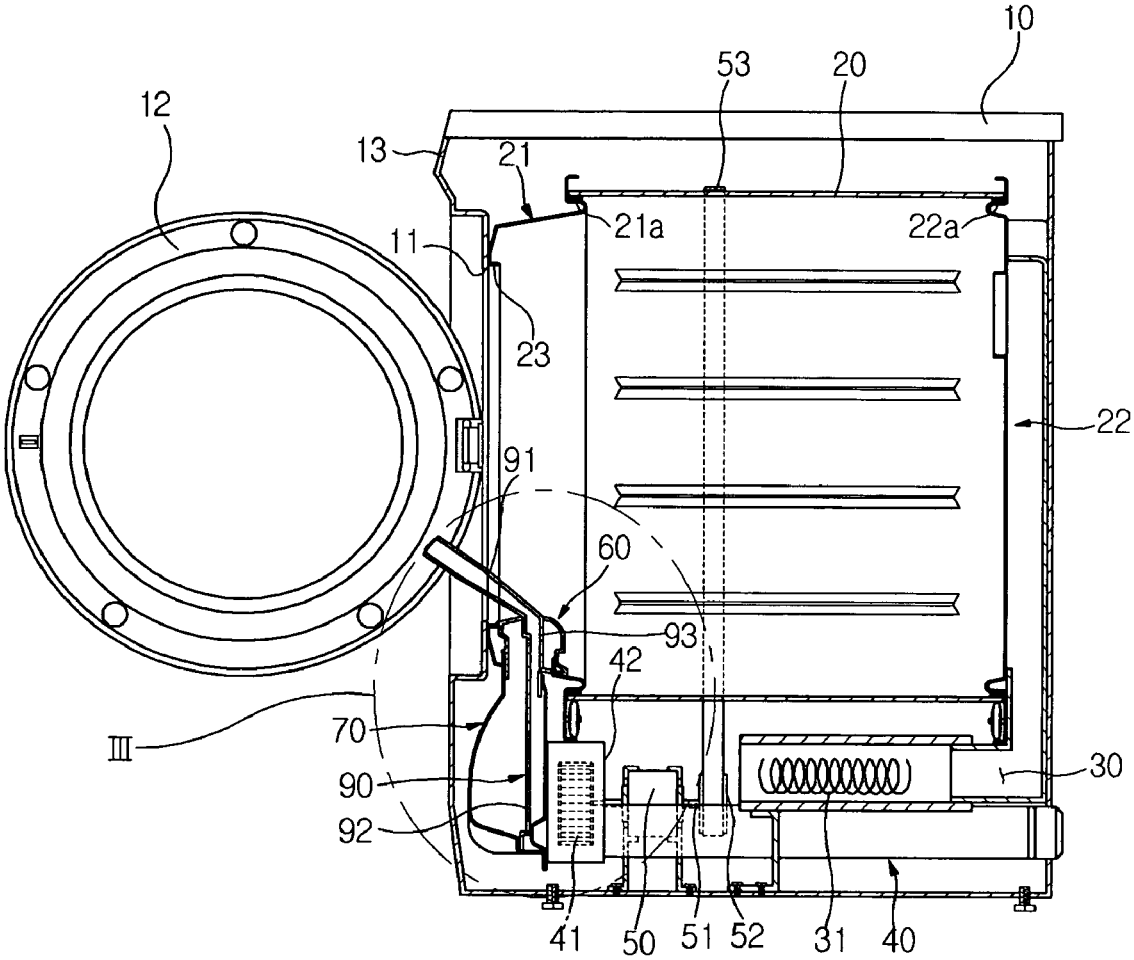
FIG. 2 is a side sectional view of the clothing dryer of FIG. 1.

FIG. 1 is perspective view of a clothing dryer consistent with an exemplary embodiment of the present invention, and FIG. 2 is a side sectional view of the clothing dryer.

Referring to FIGS. 1 and 2, the clothing dryer 100 of the present invention comprises a housing 10 forming an external appearance of the clothing dryer, a cylindrical drying tub or drum 20 rotatably disposed in the housing 10, a hot air inlet duct 30 to introduce hot air into the drying tub 20, and a hot air outlet duct 40 to discharge the hot air, coming from the drying tub 20, to the outside.

The housing 10 is provided at a front side thereof with an opening 11 to put wet laundry into or take laundry out of the housing 10 and a door 12 hinged at a side of the opening 11 to open or close the opening 11. The housing 10 is further provided at an upper end of the front side thereof with a control panel 13, which has operating buttons 13*a* to control the operation of the clothing dryer 100 and a display unit 13*b* to display operational modes of the clothing dryer 100.

The hot air inlet duct 30 incorporates a heater 31 to heat air flowing through the interior of the inlet duct 30 to produce hot air. The hot air inlet duct 30 has one end opened toward an interior space of the housing 10 and the other end connected to the drying tub 20 to supply the hot air into the drying tub 20. The hot air outlet duct 40 incorporates a blowing fan 41 in the middle thereof to generate a suction force and blowing force necessary to flow the hot air through the hot air inlet duct 30, drying tub 20 and hot air outlet duct 40 and finally discharge the hot air to the outside.

The drying tub 20 is rotatably supported in the housing 10, and is adapted to rotate using a rotating force of a drive motor 50 transmitted by way of a belt 53. The drive motor 50 is mounted in a lower region of the housing 10 and is adapted to simultaneously drive both the drying tub 20 and the blowing fan 41. For this, a rotating shaft 51 of the drive motor 50 extends from the front and rear of the drive motor 50, so that one end of the rotating shaft 51 is directly connected to the blowing fan 41 to rotate the blowing fan 41, and the other end of the rotating shaft 51 is provided with a pulley 52 to transmit the rotating force of the drive motor 50 to the drying tub 20 by way of the belt 53 surrounding the drying tub 20, thereby rotating the drying tub 20.

The drying tub 20 has a front panel 21 defining a front surface of the drying tub 20 and adapted to rotatably support a front end of the drying tub 20, and a rear panel 22 defining a rear surface of the drying tub 20 and adapted to rotatably support a rear end of the drying tub 20.

Both the front panel 21 and the rear panel 22 are provided with respective annular supporting members 21*a* and 22*a* protruding inward from their facing inner surfaces. The supporting members 21*a* and 22*a*, having such an annular form, are configured to rotatably support inner circumferences of the front and rear ends of the drying tub 20 at their outer circumferences, thereby allowing the drying tub 20 to slide on the outer circumferences, causing rotation thereof.

The hot air inlet duct 30 is mounted to the rear panel 22 to supply the hot air into the drying tub 20. In this case, the hot air from the hot air inlet duct 30 is transmitted to the rear panel 22. On the other hand, the hot air outlet duct 40 is mounted to the front panel 21 to discharge the hot air to the outside. Thereby, the hot air flows from a rear region of the drying tub 20 associated with the hot air inlet duct 30 to a front region of the drying tub 20 associated with the hot air outlet duct 40, serving to dry the wet laundry contained in the drying tub 20.

Figure 3:
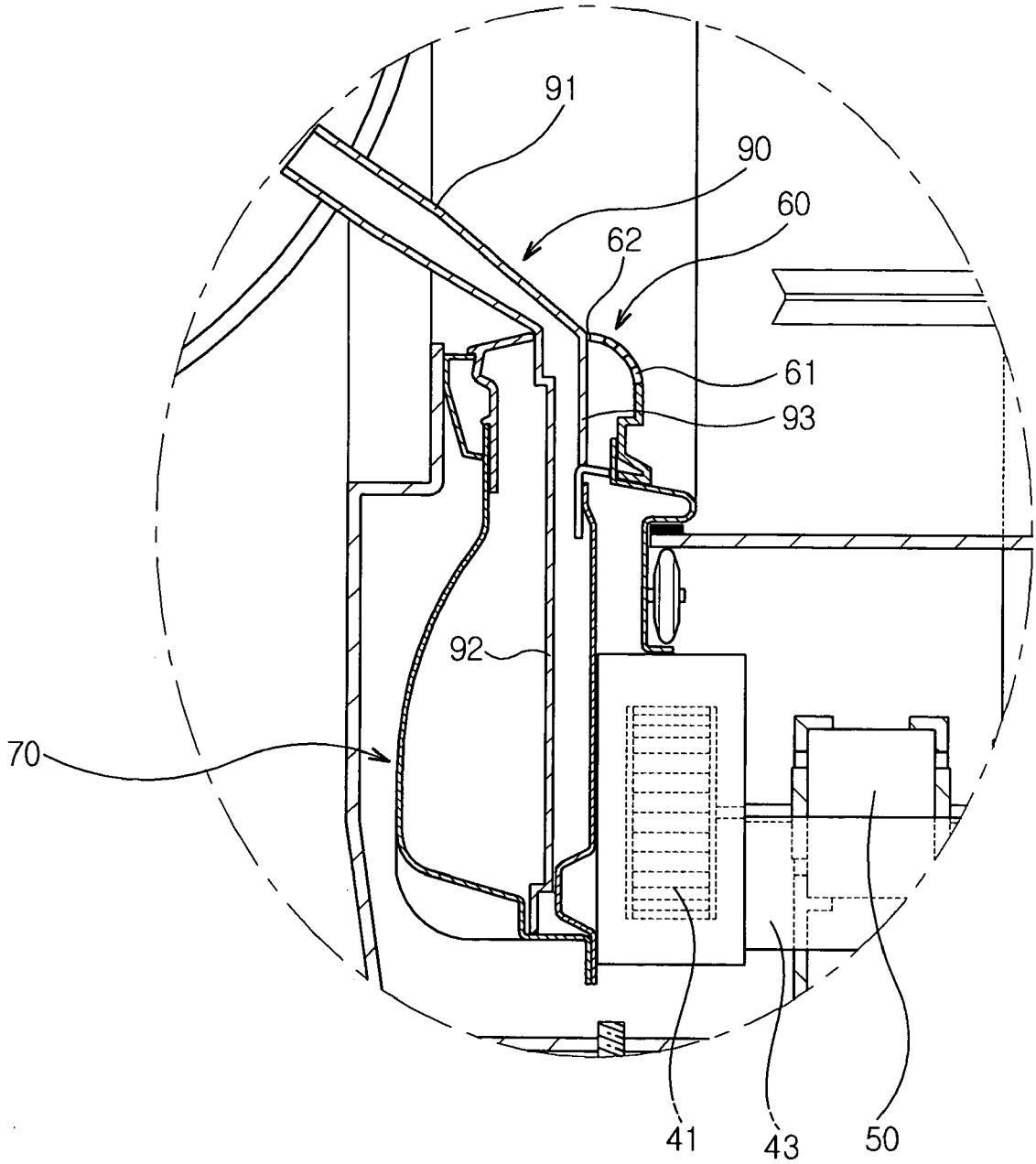
FIG. 3 is an enlarged sectional view of circle m shown in FIG. 2.

The front panel 21 has a through-hole 23 formed inside the annular supporting member 21*a* to put the laundry into or take it out of the drying tub 20. In order to prevent the laundry from being suctioned into the hot air outlet duct 40 while permitting discharge of the hot air into the hot air outlet duct 40, a grill member 60 is provided at a lower portion of the front panel 21. As shown in FIG. 3, the grill member 60 has a lattice-patterned grill portion 61 formed at an upper rear side thereof. Below the grill member 60 is provided a hot air guiding container or section 70 to guide the hot air, introduced via the grill portion 61, to the blowing fan 41 located in the lower region of the housing 10.

A filter 80 is mounted in the hot air guiding section 70 to divide an interior space of the guiding section 70 and is adapted to remove impurities, such as dust, lint, etc., from the hot air flowing to the blowing fan 41. As will be expected, the performance of the filter 80 is degraded with the passage of time due to the accumulated dust and lint, requiring periodical cleaning or exchange of the filter 80. Therefore, the filter 80 according to the present invention is detachably mounted in the hot air guiding section 70, so that it can be easily separated from the hot air guiding section 70 for the cleaning or exchange thereof when it is determined that the filter 80 causes an excessive flow resistance. For this, the grill member 60, located above the hot air guiding section 70, has a filter fitting slot 62 centrally formed at the top thereof, thereby allowing the filter 80 to be detachably mounted in the hot air guiding section 70 via the filter fitting slot 62.

The hot air outlet duct 40 extends laterally from a lower portion of the hot air guiding section 70 and then is bent rearward to extend out of the housing 10 to discharge the hot air, coming from the drying tub 20 by passing through the grill member 60 and the hot air guiding section 70, to the outside of the housing 10. The hot air outlet duct 40 includes a laterally extending fan casing 42 connected to the lower portion of the hot air guiding section 70 to guide the hot air laterally, the fan casing 42 containing the blowing fan 41 therein, and a longitudinally extending exhaust pipe 43 connected to an exit of the fan casing 42 to guide the hot air rearward. Alternatively, the laterally extending fan casing 42 is bent to guide the hot air rearward, instead of using the exhaust pipe 43.

The clothing dryer 100 of the present invention further comprises a connecting unit 90 provided as a separate external unit. The connecting unit 90 serves to connect a suction device to the hot air outlet duct 40 inside the clothing dryer 100 to communicate them with each other, thereby removing impurities, accumulated in the hot air outlet duct 40, using a suction force produced by the suction device.

Figure 4:
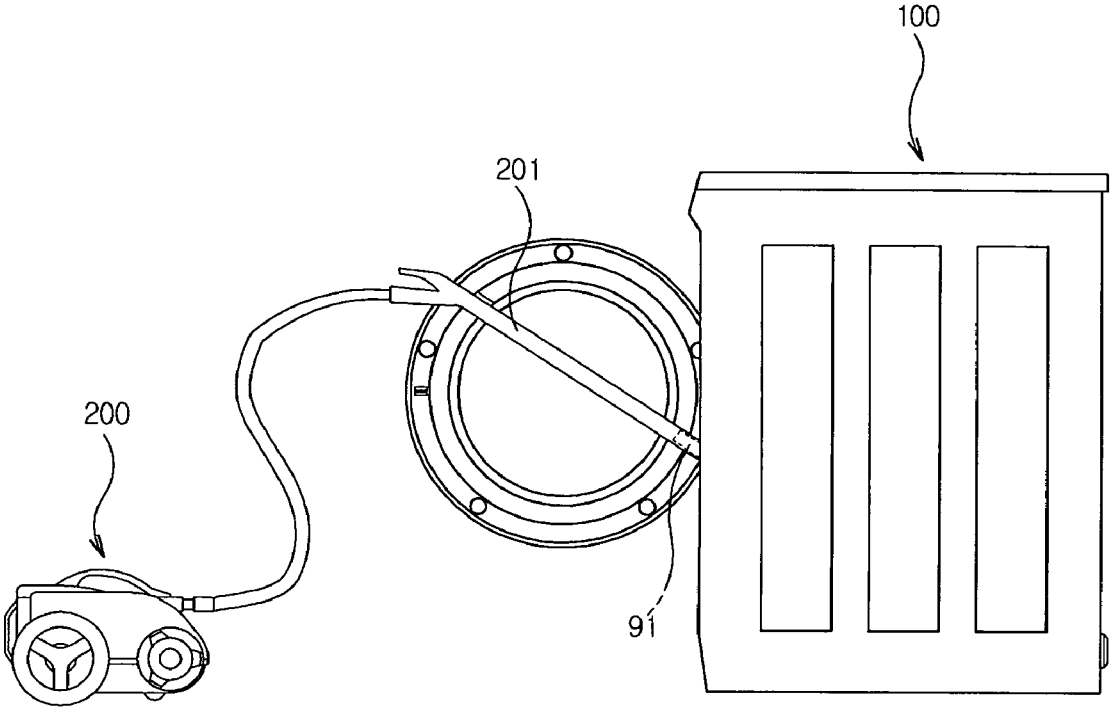
FIG. 4 is a side view of the clothing dryer connected with a vacuum cleaner using a connecting unit.

In the embodiment of the present invention, the suction device is a vacuum cleaner 200 (See. FIG. 4) to suction air and impurities, such as dust, lint, etc., accumulated in the hot air outlet duct 40, thereby cleaning the hot air outlet duct 40.

The connecting unit 90 is configured to be detachably fitted in the filter fitting slot 62 instead of the filter 80. In the case of cleaning the hot air outlet duct 40, first, the filter 80 is separated from the filter fitting slot 62, and the connecting unit 90 is fitted in the filter fitting slot 62 instead of the filter 80. Then, as the vacuum cleaner 200 is connected to the connecting unit 90 and is operated to produce a predetermined suction force, the impurities adhered to the inner peripheral surface of the hot air outlet duct 40 can be separated from the hot air outlet duct 40 and be suctioned into the vacuum cleaner 200, enabling the cleaning of the hot air outlet duct 40.

Referring to FIG. 3 illustrating circle III shown in FIG. 2 in an enlarged scale, the connecting unit 90 in accordance with the embodiment of the present invention comprises a connector portion 91 having a cylindrical outer end region for use in the connection of a suction pipe 201 of the vacuum cleaner 200 to suction air and impurities, and a guide portion 92 extending downward from the connector portion 91 to be located at the front side of the hot air outlet duct 40. The guide portion 92 acts to apply the suction force of the vacuum cleaner 200 to the hot air outlet duct 40 to guide outside air through the hot air outlet duct 40 to the connector portion 91. The connecting unit 90 further comprises a cover portion 93 located inside the grill member 60 at the front side of the grill portion 61 to isolate the grill portion 61 from a suction force acting path, thereby preventing the suction force of the vacuum cleaner 200 from affecting the drying tub 20.

FIG. 4 illustrates the clothing dryer 100 connected with the vacuum cleaner 200 via the connecting unit 90. As shown in FIG. 4, in the case of cleaning the hot air outlet duct 40, first, the connecting unit 90 is inserted into the filter fitting slot 62 and the vacuum cleaner 200 is connected to the connector portion 91 so that the suction pipe 201 of the vacuum cleaner 200 communicates with the hot air outlet duct 40 via the connecting unit 90. Then, as the vacuum cleaner 200 operates to produce a predetermined suction force, the resulting suction force is applied to the hot air outlet duct 40 to suction outside air into the vacuum cleaner 200 through the hot air outlet duct 40, guide portion 92 and connector portion 91. As the outside air flows along the hot air outlet duct 40 by the strong suction force of the vacuum cleaner 200, therefore, impurities, accumulated at the inner peripheral surface of the hot air outlet duct 40, are suctioned into the vacuum cleaner 200, enabling the cleaning of the hot air outlet duct 40. In this case, since the grill portion 61 is isolated from such a suction force acting path by the cover portion 93 of the connecting unit 90, the suction force of the vacuum cleaner 200 is not applied to the drying tub 20.

As apparent from the above description, the present invention provides a clothing dryer comprising a connecting unit to connect a hot air outlet duct with an external vacuum device, for example, a vacuum cleaner, thereby enabling impurities, accumulated in the hot air outlet duct, to be removed by a suction force of the vacuum device, resulting in an easy cleaning of the hot air outlet duct.

Although an exemplary embodiment of the present invention has been shown and described, it will be appreciated by those skilled in the art that changes may be made in this embodiment without departing from the principles and spirit of the invention, the scope of which is defined in the claims and their equivalents.

What is claimed is:

1. A clothing dryer comprising:

a drying tub for drying laundry contained therein using hot air supplied thereto;

a hot air outlet duct which discharges the hot air, coming from the drying tub, to the outside;

a connecting unit, comprising a connector portion having a cylindrical outer end region which allows the connection of an external suction device, and which transmits an external suction force to the hot air outlet duct to allow impurities accumulated in the hot air outlet duct to be removed by the external suction force, thereby enabling cleaning of the hot air outlet duct;

a grill member provided with a grill portion having a lattice pattern to permit passage of the hot air from the drying tub;

a hot air guiding section mounted below the grill member to guide the hot air, passed through the grill member, to the hot air outlet duct;

a filter detachably mounted in the hot air guiding section by passing through the grill member to separate impurities from the hot air flowing through the hot air guiding section; and a filter fitting slot formed at the grill member to detachably mount one of the filter and the connecting unit.

2. The dryer according to claim 1, wherein the connector portion guides outside air to the external suction device.

3. The dryer according to claim 2, wherein the connecting unit further includes:

a guide portion extending downwardly from the connector portion to be located at the front side of the hot air outlet duct to guide the outside air from the hot air outlet duct to the connector portion.

4. The dryer according to claim 1, wherein the connecting unit further includes a cover portion located inside the grill member at the front side of the grill portion to prevent introduction of the hot air from the drying tub.

5. The dryer according to claim 2, wherein the external suction device includes a vacuum cleaner.

6. A clothing dryer comprising:

a drying tub for drying laundry contained therein using hot air supplied thereto;

a hot air outlet duct which discharges the hot air, coming from the drying tub, to the outside;

a connecting unit, comprising a connector portion having a cylindrical outer end region and which connects an external vacuum cleaner with the hot air outlet duct to allow impurities contained in the hot air outlet duct to be suctioned into the vacuum cleaner by a suction force of the vacuum cleaner, thereby enabling cleaning of the hot air outlet duct;

a grill member provided with a grill portion having a lattice pattern to permit passage of the hot air from the drying tub;

a hot air guiding section mounted below the grill member to guide the hot air, passed through the grill member, to the hot air outlet duct;

a filter detachably mounted in the hot air guiding section by passing through the grill member to separate impurities from the hot air flowing through the hot air guiding section; and a filter fitting slot formed at the grill member to detachably mount the filter, wherein the connecting unit is detachably mounted in the hot air guiding section via the filter fitting slot, instead of the filter.

7. The dryer according to claim 6, wherein the connecting unit includes:

a guide portion located inside the hot air guiding section at the front side of the hot air outlet duct to guide the outside air from the hot air outlet duct to the connector portion; and a cover located inside the grill member at the front side of the grill portion.

8. The dryer according to claim 6, wherein the connector portion is connected to a suction pipe of the vacuum cleaner to guide outside air to the vacuum cleaner using the suction force transmitted via the suction pipe.

* * * * *